US007527125B2

(12) United States Patent
Leng et al.

(10) Patent No.: US 7,527,125 B2
(45) Date of Patent: May 5, 2009

(54) MUFFLER FOR AN EXHAUST SYSTEM

(75) Inventors: Sascha Leng, Winnenden (DE); Marco Jess, Leonberg (DE); Sebastian Hutschenreuther, Reichenbach (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 144 days.

(21) Appl. No.: 11/708,922

(22) Filed: Feb. 21, 2007

(65) Prior Publication Data

US 2007/0205045 A1 Sep. 6, 2007

(30) Foreign Application Priority Data

Feb. 23, 2006 (DE) ..... 10 2006 008 941

(51) Int. Cl.

| | |
|---|---|
| ***F01N 1/02*** | (2006.01) |
| ***F01N 1/04*** | (2006.01) |
| ***F01N 1/10*** | (2006.01) |
| *F01N 1/08* | (2006.01) |

(52) U.S. Cl. ..... 181/250; 181/266; 181/273; 181/276; 181/272

(58) Field of Classification Search ..... 181/250, 181/252, 251, 266, 273, 276, 268, 272
See application file for complete search history.

(56) References Cited

U.S. PATENT DOCUMENTS

| | | | | | |
|---|---|---|---|---|---|
| 1,954,516 | A * | 4/1934 | Bourne | 181/256 |
| 2,103,810 | A * | 12/1937 | Caspar | 181/273 |
| 2,297,046 | A * | 9/1942 | Bourne | 181/250 |
| 3,396,812 | A * | 8/1968 | Wilcox et al. | 181/250 |
| 3,402,785 | A * | 9/1968 | Heath et al. | 181/250 |
| 3,434,565 | A * | 3/1969 | Fischer | 181/250 |
| 3,776,364 | A * | 12/1973 | Van Doeren | 181/228 |
| 4,192,403 | A * | 3/1980 | Nakagawa et al. | 181/268 |
| 4,501,341 | A * | 2/1985 | Jones | 181/250 |
| 4,821,840 | A * | 4/1989 | Harwood et al. | 181/282 |
| 4,841,728 | A * | 6/1989 | Jean et al. | 60/312 |
| 4,892,168 | A * | 1/1990 | Sasaki et al. | 181/250 |
| 7,004,283 | B2 * | 2/2006 | Worner et al. | 181/239 |
| 2006/0283660 | A1 * | 12/2006 | Cai | 181/252 |

FOREIGN PATENT DOCUMENTS

| | | | |
|---|---|---|---|
| DE | 3807948 | | 9/1989 |
| DE | 3807948 | A1 | 9/1989 |
| GB | 403651 | | 12/1933 |
| JP | 59000514 | A * | 1/1984 |
| JP | 59041618 | A * | 3/1984 |
| JP | 63285213 | A * | 11/1988 |
| JP | 02099709 | A * | 4/1990 |

* cited by examiner

*Primary Examiner*—Edgardo San Martin
(74) *Attorney, Agent, or Firm*—Howard IP Law Group, PC

(57) ABSTRACT

The present invention relates to a muffler for an exhaust system of an internal combustion engine, including a housing having at least one absorption chamber which is filled with an absorbent material that has an absorbent effect for airborne sound, a straight-through pipe that carries exhaust gas during operation of the muffler and passes through the housing, and at least one blind pipe that is connected at one end laterally to the straight-through pipe and is sealed at the other end. The blind pipe has a wall that is acoustically transmissive for airborne sound in an area running in the absorption chamber.

17 Claims, 1 Drawing Sheet

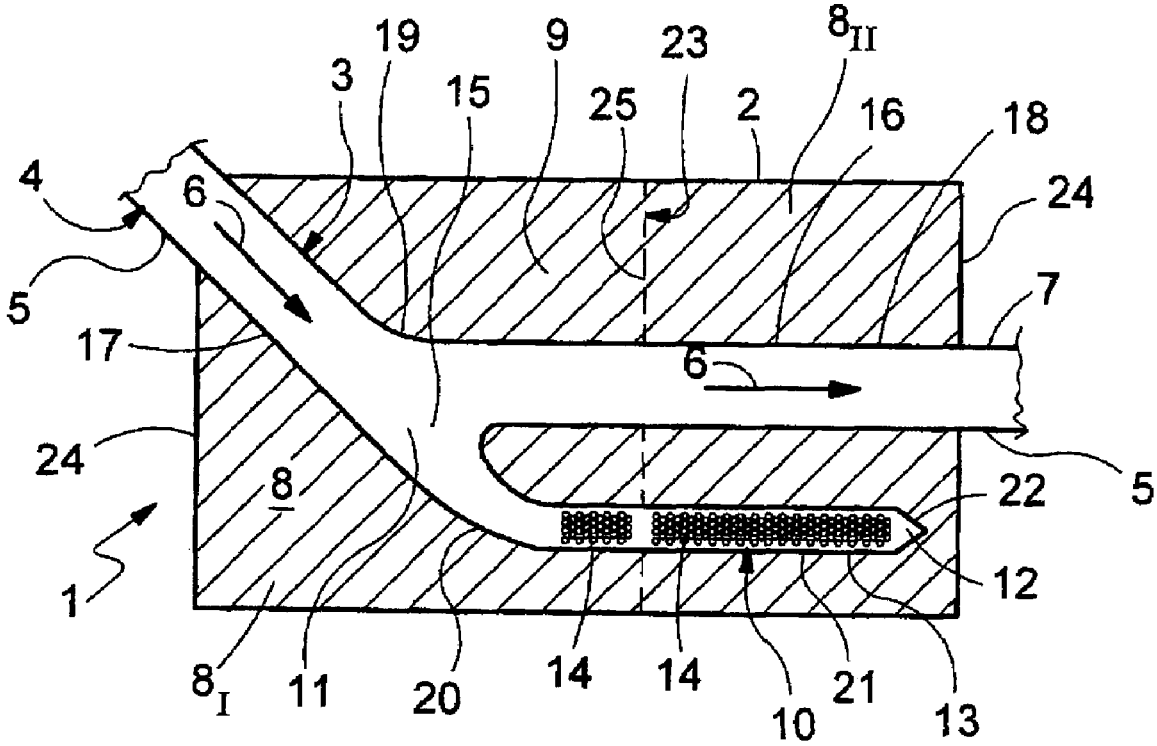
19
9
23
8II
3
15
25
2
16
18
4
6
24
5
7
17
6
24
5
8
22
1
12
8I
11
20
14
14
10
21
13

MUFFLER FOR AN EXHAUST SYSTEM

FIELD OF THE INVENTION

The present invention relates to a muffler for an exhaust system of an internal combustion engine.

BACKGROUND OF THE INVENTION

Several different mufflers may be arranged in series in the exhaust system of a motor vehicle in particular. For example, a front muffler, a middle muffler and a rear muffler may be differentiated. A rear muffler is situated near an end pipe from which the exhaust is emitted to the environment. For example, such a rear muffler may include a housing containing an absorption chamber filled with an absorbent agent. A pipe carrying exhaust gas in the muffler is connected to the exhaust system or forms a part of an exhaust line of the exhaust system, passing through the housing and the absorption chamber. Inside the absorption chamber, a wall of this straight-through pipe is perforated, so that airborne sound entrained in the stream of exhaust gas can enter the absorption chamber and be absorbed in the absorbent material. This achieves a certain damping characteristic. In particular, middle frequencies and higher frequencies are muffled to a relatively great extent with this design, whereas lower frequencies are muffled only to a comparatively minor extent. This circumstance may be utilized for a targeted sound design.

In certain applications, e.g., in an exhaust system for an internal combustion engine of a motor vehicle, it may be desirable to reduce the sound pressure level of the lower frequencies while at the same time emphasizing the middle frequencies.

SUMMARY OF THE INVENTION

The invention relates to the problem of providing a muffler which in one embodiment enables significant reduction in the sound level at lower frequencies and at high frequencies and by comparatively weak damping of the middle frequencies.

In one aspect of the invention, a blind pipe branches off from the straight-through pipe passing through the housing and has a wall that is acoustically transmissive for airborne sound inside the absorption chamber. Shifting the area that is acoustically transmissive for airborne sound into the blind pipe leads to a weakening of the damping characteristic with respect to middle frequencies, whereas the damping effect for higher frequencies remains essentially high and unchanged. At the same time, this design results in the straight-through pipe allowing the middle frequencies to pass through better, which means an amplification of the middle frequencies in comparison with a traditional design, while the straight-through pipe seemingly has a greater length for the lower frequencies that results in a greater level reduction for the lower frequencies. In comparison with a traditional design with a radially sound-transmitting straight-through pipe, the inventive design with a radially sound-transmitting blind pipe branching off from the straight-through pipe has a damping characteristic which produces a greater drop in sound level at lower frequencies, a weaker damping effect and/or a (slight) amplification at middle frequencies and approximately uniform damping at higher frequencies. At the same time, the inventive muffler has a structurally simple design, so it is especially suitable for mass production.

In an exemplary embodiment, the straight-through pipe may have a wall that is not acoustically transmissive for airborne sound in the interior of the housing and/or in the interior of the absorption chamber, not including a connection point by which the blind pipe is connected to the straight-through pipe. This measure makes it possible to improve the damping effect with respect to lower frequencies and to improve the acoustic transmissivity for the middle frequencies.

It is self-evident that the features mentioned above and those to be cited below can be used not only in the particular combination indicated but also in other combinations or alone without going beyond the scope of the present invention.

An exemplary embodiment of the invention is depicted in the drawing and explained in greater detail in the following description.

BRIEF DESCRIPTION OF THE DRAWINGS

The FIGURE shows a simplified schematic longitudinal section through a muffler.

DETAILED DESCRIPTION OF THE INVENTION

According to FIGURE, a muffler 1 includes a housing 2 and a straight-through pipe 3 passing through the housing 2. The muffler 1 is for installation in an exhaust system 4 (shown only partially) of an internal combustion engine. To this end, the straight-through pipe 3 can be connected to an exhaust line 5 of the exhaust system 4. Accordingly, the straight-through pipe 3 serves to carry exhaust gas during operation of the exhaust system 4 and/or during operation of the internal combustion engine equipped with this system. The direction of flow of the exhaust gases in the straight-through pipe 3 is preferably as indicated by arrows 6 in FIG. 1. The muffler 1 is preferably designed to as a rear muffler, whereby the straight-through pipe 3 is then connected at the outlet end to an end pipe 7 of the exhaust system 4 or itself forms the end pipe 7 of the exhaust system 4 and/or the exhaust line 5.

At least one absorption chamber 8 is provided in the housing 2. In the example shown here, essentially the entire interior of the housing 2 is formed by the absorption chamber 8. The absorption chamber 8 is filled with an absorbent material 9 that has an absorbent effect for airborne sound.

At least one blind pipe 10 is connected to the straight-through pipe 3 in the interior of the housing 2. The blind pipe 10 here is connected at one end laterally at 11 to the straight-through pipe 3, but it is sealed at the other end at 12. The blind pipe 10 has a wall 13 that is acoustically transmissive for airborne sound in an area that is not identified further here but extends in the absorption chamber 8. Wall 13 of the blind pipe 10 may be provided with perforations 14 in at least some sections.

The straight-through pipe 3 passes through the housing 2 without interruptions, apart from a side opening 15 through which the blind pipe 10 is connected to the straight-through pipe 3. In addition, the straight-through pipe 3 may preferably be designed so that it has a wall 16 that is not acoustically transmissive for airborne sound, not including the side opening 15. In particular, the wall 16 of the straight-through pipe 3 is not perforated. In certain cases, it may also be necessary to provide the straight-through pipe 3 with a wall that is acoustically transmissive for airborne sound (e.g., for damping flow noises). In the present case, the absorption chamber 8 completely fills up the interior of the housing 2, so the straight-through pipe 3 necessarily also passes through the absorption chamber 8.

In the present case, the straight-through pipe 3 has a linear inlet section 17, which leads into the housing 2, a linear outlet section 18, which leads out of the housing 2, and a curved section 19 connecting the two linear sections 17, 18. The straight-through pipe 3 thus has a bend in the housing 2 formed by the curved section 19. The blind pipe 10 is preferably connected to the straight-through pipe 3 in the area of the curved section 19, namely in particular on the outside radially with respect to the radius of the curve. The side opening 15 is thus on the outside of the curved section 19. In the linear sections 17, 18, the straight-through pipe 3 preferably has a constant inside cross section, which may be of the same size in particular.

The blind pipe 10 has a curved connecting section 20 and a linear end section 21. The end section 21 is closed at the end, i.e., at 12, and is connected to the straight-through pipe 3 via the curved connecting section 20. In the example shown here, the wall 13 that is acoustically transmissive for airborne sound is provided exclusively in the linear end section 21.

As shown here, the blind pipe 10 may have a constant inside cross section at least in the end section 21. The closed end 12 of the blind pipe 10 may be provided with a conical end piece 22, for example.

In addition, the exemplary embodiment shown here is characterized in that the outlet section 18 of the straight-through pipe 3 and the end section 21 of the blind pipe 10 run essentially parallel to one another. This makes it possible to achieve an especially compact design for the muffler 1. However, the position of the pipes 3, 10 in relation to one another may also deviate from the parallel pipe guidance because of different structural designs.

To increase the stability of the muffler 1, the housing 2 may be equipped with at least one intermediate bottom 23 extending, e.g., essentially parallel to the two end faces 24 of the housing 2. The intermediate bottom 23 subdivides the absorption chamber 8 into two partial chambers $\mathbf{8}_I$ and $\mathbf{8}_{II}$. The intermediate bottom 23 is preferably designed to be acoustically transmissive for airborne sound, so it is preferably provided with perforations 25. The straight-through pipe 3 passes through the intermediate bottom 23 and is supported on it laterally or radially. Likewise, the blind pipe 10 also passes through the intermediate bottom 23 and is supported laterally on it. The respective pipe 3, 10 may be attached to or mounted on the intermediate bottom 23 by means of a sliding seat.

It can be seen here that the perforations 14 in the wall 13 are interrupted in the area where the blind pipe 10 is supported on the intermediate bottom 23 in order to increase the strength of the blind pipe 10 there.

To achieve the simple and inexpensive design shown here, the housing 2 contains only a single absorption chamber 8. In addition, only a single straight-through pipe 3 is expediently provided. Likewise, only a single blind pipe 10 is provided here. However, it is clear that in another embodiment, two or more blind pipes 10 may also branch off from the straight-through pipe 3.

Due to the proposed design of the muffler 1, a special damping characteristic can be achieved. It is characterized in that it achieves a relatively strong decrease in sound level at lower frequencies and at higher frequencies while achieving a relatively minor damping at medium frequencies and even achieving a type of amplification in comparison with traditional mufflers. With regard to the frequencies to be muffled, the blind pipe 10 may optionally also be designed as a $\lambda/4$ pipe, which can improve the specific damping of certain frequencies.

The sound spectrum of an internal combustion engine designed as a piston engine is determined by the number of ignition processes per crankshaft revolution and by the rotational speed of the internal combustion engine and/or the rotational speed of the crankshaft. The lowest characteristic frequency of a piston engine is obtained based on the number of ignition processes per second. In a four-cylinder engine with a four-stroke system, there will be two ignition processes per revolution of the crankshaft. With regard to the engine speed, the main frequency of the sound thereby generated is thus of the second order, which is also referred to as the main order. This main order forms the low frequencies of the engine sound. Middle frequencies then have a higher engine order, e.g., the fourth, sixth and eighth engine orders.

The muffler 1 may be designed in a targeted manner, for example, so that the main engine order (e.g., the second order) is lowered to a comparatively great extent while the next-higher engine orders, preferably the fourth, sixth and eighth engine orders, leave the muffler 1 comparatively undamped. Even higher orders are classified with the high frequencies which are preferentially absorbed in the absorbent material 9. In an internal combustion engine with a different number of cylinders and/or a different combustion process (e.g., a two-stroke system), this then yields different main engine orders for the low frequencies and other higher engine orders for the middle frequencies accordingly.

The invention claimed is:

1. A muffler for an exhaust system of an internal combustion engine, comprising:

a housing containing at least one absorption chamber which is filled with an absorbent material having an absorbent effect for airborne sound;

a straight-through pipe carrying exhaust gas during operation of the muffler, said straight-through pipe passing through said housing; and at least one blind pipe connected at a first end laterally to said straight-through pipe, said at least one blind pipe being closed at a second end;

wherein said blind pipe has a wall that is acoustically transmissive for airborne sound in an area running in said at least one absorption chamber, wherein said straight-through pipe passes through said housing without interruptions apart from a connection point through which said blind pipe is connected to said straight-through pipe, and wherein said straight-through pipe further comprises a wall that is not acoustically transmissive for airborne sound.

2. The muffler according to claim 1, wherein said straight-through pipe passes through said absorption chamber.

3. The muffler according to claim 1, wherein said straight-through pipe further comprises;

a first linear inlet section leading into said housing;

a second linear outlet section leading out of said housing; and a curved section connecting said first linear inlet section with said second linear outlet section.

4. The muffler according to claim 1, wherein said blind pipe is connected to said straight-through pipe in the area of said curved section.

5. The muffler according to claim 1, wherein said blind pipe further comprises a linear end section that is closed at one end; and a curved connecting section connecting said linear end section to said straight-through pipe.

6. The muffler according to claim 5, wherein said end section comprises a wall that is acoustically transmissive for airborne sound.

7. The muffler according to claim 5, wherein said outlet section of said straight-through pipe and said end section of said blind pipe extend essentially parallel to one another in said housing.

8. The muffler according to claim 1, wherein said housing comprises at least one intermediate bottom that subdivides said absorption chamber into first and second partial chambers.

9. The muffler according to claim 8, wherein said intermediate bottom is acoustically transmissive for airborne sound.

10. The muffler according to claim 8, wherein said straight-through pipe passes through said intermediate bottom and is supported on said intermediate bottom.

11. The muffler according to claim 8, wherein said blind pipe passes through said intermediate bottom and is supported on said intermediate bottom.

12. The muffler according to claim 1, wherein said straight-through pipe has essentially a constant flow cross section at least inside said housing and apart from the connection point through which said blind pipe is connected to said straight-through pipe.

13. The muffler according to claim 1, wherein said blind pipe has essentially a constant cross section.

14. The muffler according to claim 1, wherein said blind pipe further comprises a conical end piece.

15. The muffler according to claim 1, wherein said absorption chamber fills up the interior of said housing.

16. The muffler according to claims 1, wherein said muffler comprises a rear muffler.

17. An exhaust system for an internal combustion engine, having at least one muffler comprising:

a housing containing at least one absorption chamber which is filled with an absorbent material having an absorbent effect for airborne sound;

a straight-through pipe carrying exhaust gas during operation of the muffler, said straight-through pipe passing through said housing; and at least one blind pipe connected at a first end laterally to said straight-through pipe, said at least one blind pipe being closed at a second end;

wherein said blind pipe has a wall that is acoustically transmissive for airborne sound in an area running in said at least one absorption chamber, wherein said straight-through pipe passes through said housing without interruptions apart from a connection point through which said blind pipe is connected to said straight-through pipe, wherein said straight-through pipe further comprises a wall that is not acoustically transmissive for airborne sound, and wherein said straight-through pipe forms an end pipe of the exhaust system downstream from said housing.

* * * * *

UNITED STATES PATENT AND TRADEMARK OFFICE

CERTIFICATE OF CORRECTION

PATENT NO. : 7,527,125 B2
APPLICATION NO. : 11/708922
DATED : May 5, 2009
INVENTOR(S) : Sascha Leng, Marco Jess and Sebastian Hutschenreuther It is certified that error appears in the above-identified patent and that said Letters Patent is hereby corrected as shown below:

Title page, item (75), line 2, change “Leonberg” to --Esslingen--.

Signed and Sealed this

Ninth Day of June, 2009

JOHN DOLL
*Acting Director of the United States Patent and Trademark Office*